US006685585B2

(12) United States Patent
Shishido et al.

(10) Patent No.: US 6,685,585 B2
(45) **Date of Patent: *Feb. 3, 2004**

(54) BALL FOR BALL GAME

(75) Inventors: Hideomi Shishido, Hiroshima (JP); Shigeo Doi, Hiroshima (JP); Yoshihisa Okimura, Hiroshima (JP)

(73) Assignees: adidas International B.V. (NL); Molten Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/293,847

(22) Filed: Nov. 13, 2002

(65) Prior Publication Data

US 2003/0078119 A1 Apr. 24, 2003

Related U.S. Application Data

(63) Continuation of application No. 09/700,615, filed as application No. PCT/JP99/02667 on May 20, 1999, now Pat. No. 6,503,162.

(30) Foreign Application Priority Data

May 22, 1998 (JP) ..... 10-141882

(51) Int. Cl.[7] ..... A63B 41/10
(52) U.S. Cl. ..... 473/605; 473/599
(58) Field of Search ..... 473/598, 599, 473/603, 604, 605, 607

(56) References Cited

U.S. PATENT DOCUMENTS

| | | | | |
|---|---|---|---|---|
| 1,187,029 | A | 6/1916 | Beebout | |
| 1,923,236 | A | 8/1933 | Sonnett | |
| 3,119,618 | A | 1/1964 | Molitor et al. | |
| 4,333,648 | A | 6/1982 | Aoyama | |
| 4,660,831 | A | 4/1987 | Kralik | |
| 4,856,781 | A | 8/1989 | Shishido et al. | |
| 5,752,890 | A | 5/1998 | Shishido et al. | |
| 5,759,123 | A | 6/1998 | Ou | |
| 5,772,545 | A | 6/1998 | Ou | |
| 6,099,423 | A | 8/2000 | Ou | |
| 6,206,795 | B1 | 3/2001 | Ou | |
| 6,302,815 | B1 | 10/2001 | Shishido et al. | |
| 6,503,162 | B1 * | 1/2003 | Shishido et al. | 473/605 |

FOREIGN PATENT DOCUMENTS

| | | |
|---|---|---|
| JP | 27-3908 | 5/1952 |
| JP | 38-16729 | 8/1963 |
| JP | 8-252341 | 10/1996 |
| JP | 09-019516 | 1/1997 |
| JP | 10-323409 | 12/1998 |

* cited by examiner

*Primary Examiner*—Steven Wong
(74) *Attorney, Agent, or Firm*—Testa, Hurwitz & Thibeault, LLP

(57) ABSTRACT

A ball for a ball game includes an elastic bladder having the form of a spherical hollow body into which compressed air is charged, a reinforced layer formed on a whole surface of the bladder, and a plurality of leather panels bonded onto the reinforced layer directly or through a cover rubber layer, wherein a peripheral edge portion of the leather panel is folded toward an inside and a thickness adjusting member for eliminating a difference in step caused by the folding of the leather panel is caused to be bonded onto the back of the leather panel surrounded by the folded portion of the leather panel.

12 Claims, 8 Drawing Sheets

BALL FOR BALL GAME

CROSS-REFERENCE TO RELATED APPLICATIONS

This application is a continuation of U.S. patent application Ser. No. 09/700,615, filed Nov. 17, 2000, now U.S. Pat. No. 6,503,162 which is a 371 of PCT/JP/99/02667, filed May 20, 1999, which claims priority to Japanese Patent Application No. 141882/1998, filed May 22, 1998, the entire contents of which are hereby incorporated herein by reference.

TECHNICAL FIELD

The present invention relates to ball for ball games such as a soccer ball, a handball, a volleyball and the like.

BACKGROUND ART

Conventionally, there have been two kinds of balls for ball games having an air charging structure, for example, a laminated ball and a hand stitched ball.

As disclosed in the specification of U.S. Pat. No. 4,333,648, for example, the laminated ball comprises a rubber bladder made of air impermeable rubber and having a spherical hollow body into which compressed air is charged through a valve, a reinforced layer formed by winding a fiber such as a nylon filament having several thousands meters onto the bladder in every circumferential direction in order to stabilize the quality of the ball (weight, size, sphericity, durability, shape maintenance, and an enhancement in strength for a change with the passage of time), a cover rubber layer made of a thin vulcanized rubber layer bonded onto the reinforced layer, and an outermost layer including a plurality of leather panels bonded onto the cover rubber layer. The cover rubber layer has the function of tightly bonding the leather panel onto the ball. An artificial leather panel or a natural leather panel is used for the leather panel. In many cases, an end of the back of the leather panel is usually cut obliquely (which is referred to as diagonally cutting), and a trench having an almost V shape is formed on a leather panel joint.

Since the ball having such a structure can be mechanically manufactured, it has good productivity (a small variation in weight and size) and is generally inexpensive. In addition, such a ball is excellent in sphericity and durability. On the other hand, the trench formed on the panel joint has a great width (usually about 8 mm) and has a shallow depth (usually about 1 mm). Therefore, there is a problem in that an air resistance cannot be reduced and a flight cannot be increased. There is a further problem in that the ball has poor gripping properties and is hard to grip.

The hand stitched ball has a structure in which the same bladder as described above is housed in an outermost layer having a spherical shape which is formed by folding edges of a plurality of leather panels toward the inside and sewing them together with a thread (usually about 10000 deniers). The same artificial leather or natural leather is used for the leather panel. A backing member formed by sticking a plurality of woven fabrics is usually bonded onto the back of the leather panel. More specifically, the woven fabrics are bonded onto the back of the leather panel with an adhesive such as a latex paste, thereby reinforcing the leather panel. The hand stitched ball having such a structure has been disclosed in Japanese Unexamined Patent Publication No. 19516/1997, for example.

According to the ball having such a structure, the leather panel is folded toward the inside together with the backing member. Therefore, a trench to be formed in this portion has a smaller width of about 2.5 mm and a greater depth of about 2.0 mm than in the laminated ball. Therefore, the ball has advantages that an air resistance can be reduced, a flight can be increased, and excellent gripping properties, that is, easiness to grip by hands, good operability and excellent ball controllability can be obtained. However, since the ball is a solid, it cannot be stitched by a machine but should be stitched by hands. For this reason, there is a problem in that a lot of skill is required, an individual variation is increased and productivity is poor. In addition, the quality is also uneven, and variations in weight, size and sphericity are easily generated.

When an internal pressure of about 1.0 kg/cm$^2$ and shock such as kick are applied to the ball, force or shock of several hundreds kilograms or more is applied. For this reason, there is a drawback that seam opening is caused. Consequently, the size of the ball is increased more than the standard or is deformed in some cases. In the worst case, there is a danger that the thread might be broken or be unknotted due to the shock to cause the bladder to project. The durability of the hand stitched ball is usually about ½ to ⅓ of that of the laminated ball.

It is an object of the present invention to improve aerodynamic characteristics and the like of the structure of the laminated ball. The present invention solves the above-mentioned problems by forming the same trench as in the hand stitched ball on the joint of the leather panel of the ball, and realizes a ball having the flight, gripping properties and ball controllability of the hand stitched ball while keeping the quality of the laminated ball (weight, size, sphericity, durability, shape maintenance, and an enhancement in strength for a change with the passage of time).

DISCLOSURE OF THE INVENTION

The present invention provides a ball for a ball game comprising an elastic bladder having the form of a spherical hollow body into which compressed air is charged, a reinforced layer formed on a whole surface of the bladder, and a plurality of leather panels bonded onto the reinforced layer directly or through a cover rubber layer, wherein a peripheral edge portion of the leather panel is folded toward an inside and a thickness adjusting member bonded onto the back of the leather panel surrounded by the folded portion of the leather panel. According to such a structure, a trench having the same shape as the shape of a hand stitched ball is formed on a joint of the adjacent leather panels. The trench reduces air resistance, enhances gripping properties and gives easiness to grip the ball. Accordingly, operability and ball controllability can be enhanced. By the existence of the thickness adjusting member, the back of the leather panel is a flat face. Consequently, the difference in step caused by the folding does not appear on the surface of the leather panel.

A ball for a ball game according to the present invention is characterized in that the peripheral edge portion of the leather panel is folded toward the inside by about 180 degrees. According to such a structure, the folded portion of the leather panel is bonded onto the cover rubber layer or the reinforced layer. Therefore, even if peeling is caused on the panel joint, there is little possibility that the folded portion might be turned over to appear on the surface of the ball.

A ball for a ball game according to the present invention is characterized in that the peripheral edge portion of the leather panel is folded toward the inside by about 90 degrees. According to such a structure, the folded portion of the leather panel is not inserted between the cover rubber layer or the reinforced layer and the thickness adjusting member. Therefore, there is no possibility that the thickness of the folded portion might appear as an irregularity on the surface of the leather panel.

A ball for a ball game according to the present invention is characterized in that the leather panel is bonded in the joint to the adjacent leather panel. According to such a structure, water can be prevented from entering the joint of the leather panels. In addition, the peeling of the leather panel can be prevented so that durability can be enhanced.

A ball for a ball game according to the present invention is characterized in that a notch is formed in the folded portion of the leather panel. According to such a structure, the folding can easily be performed like a curved line.

A ball for a ball game according to the present invention is characterized in that the thickness adjusting member is made of a woven fabric. According to such a structure, the bias effect of the woven fabric can prevent the ball from being deformed when external force is applied to the ball. Also in the case where such external force to damage the leather panel is applied, the force is intercepted by the woven fabric so that the bladder can be protected.

A ball for a ball game according to the present invention is characterized in that the thickness adjusting member is made of a shock absorbing member. According to such a structure, the external force applied to the ball is absorbed and relieved by the shock absorbing member. Consequently, a feeling can become soft when the ball hits a human body.

A ball for a ball game according to the present invention is characterized in that the thickness adjusting member has a lamination structure of the woven fabric and the shock absorbing member. According to such a structure, the shock absorbing member and the bladder which are provided on the inside can be protected by the woven fabric, and the shock absorbing function can be obtained by the shock absorbing member.

A ball for a ball game according to the present invention is characterized in that the shock absorbing member is formed of a foaming member, a nonwoven fabric, a bulky woven fabric or a honeycomb construction member. According to such a structure, the shock absorbing member and the bladder which are provided on the inside can be protected by the woven fabric, and the shock absorbing function can be obtained by the shock absorbing member.

A ball for a ball game according to the present invention is characterized in that the reinforcing member is provided between the leather panel and the thickness adjusting member. According to such a structure, when force to extend the leather panel is applied by the internal pressure of the bladder, the reinforced member inhibits the extension so that the expansion of the ball can be suppressed. Also in the case where the external force to damage the leather panel is applied, the force can be intercepted by the reinforced layer so that the bladder can be protected.

A ball for a ball game according to the present invention is characterized in that the reinforced layer is made of a polyester film, a PVC film, a polyethylene film or a polypropylene film. According to such a structure, it is possible to obtain a reinforced layer having flexibility, light weight and small thickness.

BEST MODE FOR CARRYING OUT THE INVENTION

Next, a ball for a ball game according to an embodiment of the present invention will be described in detail with reference to the accompanying drawings.

Embodiment 1

Figure 1:
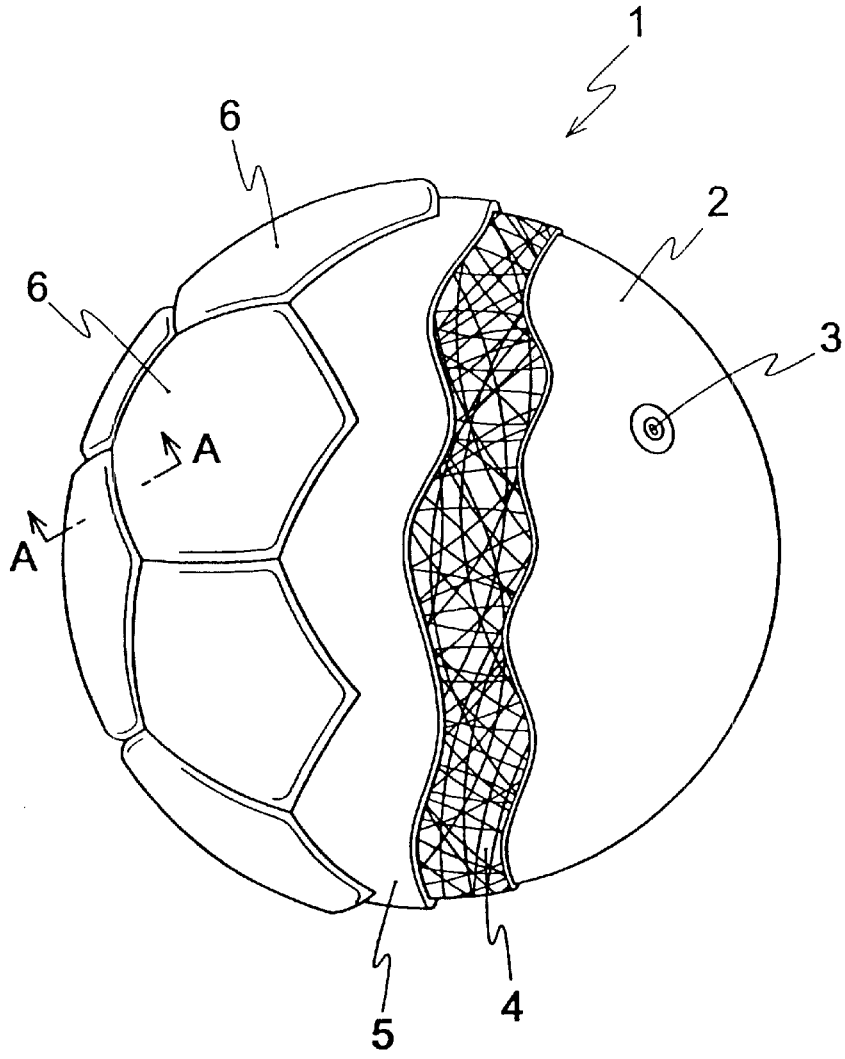
FIG. 1 is a perspective view showing a ball for a ball gave according to an embodiment of the present invention, a part of which being cut away.

In FIG. 1, the reference numeral 1 denotes an example of a soccer ball and the reference numeral 2 denotes a bladder made of an elastic material having air impermeability such as butyl rubber in the form of a spherical hollow body, into which compressed air is charged. The reference numeral 3 denotes a valve for injecting the compressed air into the bladder 2, an internal pressure being set to about 1.0 kg/cm$^2$. The reference numeral 4 denotes a reinforced member formed by winding a fiber, for example, a nylon filament having a length of about 3000 m onto the surface of the bladder 2 in every direction on a circumference. The quality of the ball can be enhanced and stabilized by the reinforced layer 4 as described above. The reinforced layer 4 can be formed by overlapping a plurality of woven fabrics such as cotton fabrics together and sticking them onto the surface of the bladder 2 or sewing the woven fabrics spherically as well as winding a thread as described above. In addition, elastomer such as polyurethane, polyester, nylon or polyolefine which is molded spherically or rubber blended with a reinforced fiber can be used as the bladder. The bladder having such a structure itself has a reinforcing function. Therefore, a special reinforced layer does not need to be provided. The reference numeral 5 denotes a cover rubber layer made of natural rubber or the like which is formed on the reinforced layer 4, and the reference numerals 6 denote a leather panel bonded onto the cover rubber layer 5 with an adhesive such as a CR (chloroprene) based adhesive. A thickness adjusting member 10 which will be described below is bonded onto the back of the leather panel 6.

In the present embodiment, a whole spherical surface is covered with twelve pentagonal panels and twenty hexagonal panels onto which the thickness adjusting member 10 is bonded. The cover rubber layer 5 functions to strengthen the bonding of the leather panel 6 onto the thickness adjusting member 10. It is also possible to employ a structure in which the leather panel 6 is directly bonded onto the reinforced layer 4. In particular, if the sticking structure of the woven fabric or the sewing structure of the woven fabric is employed as the reinforced layer 4, the cover rubber layer 5 is omitted in many cases. Furthermore, the cover rubber layer 5 can also be formed only on the joints of the leather panels 6. An artificial leather (including a synthetic leather, and so forth) or a natural leather is used for the leather panels 6. A backing member made of a woven fabric or the like for reinforcement can also be bonded onto the back of the leather panel 6. In this case, the leather panel 6 is used including the backing member.

Figure 2:
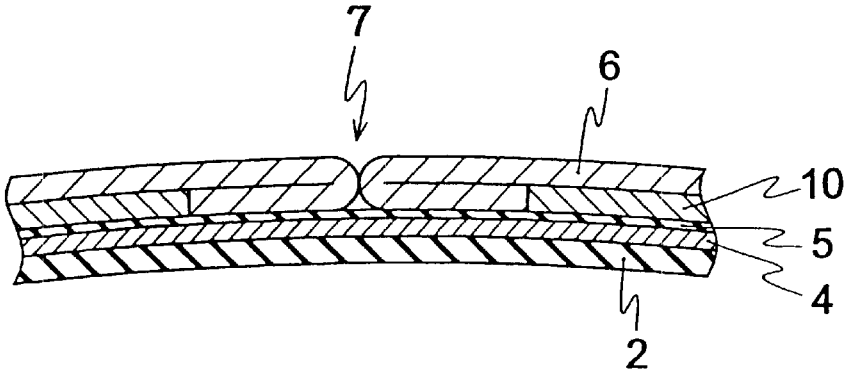
FIG. 2 is a sectional view taken along the line A—A in FIG. 1.
Figure 3:
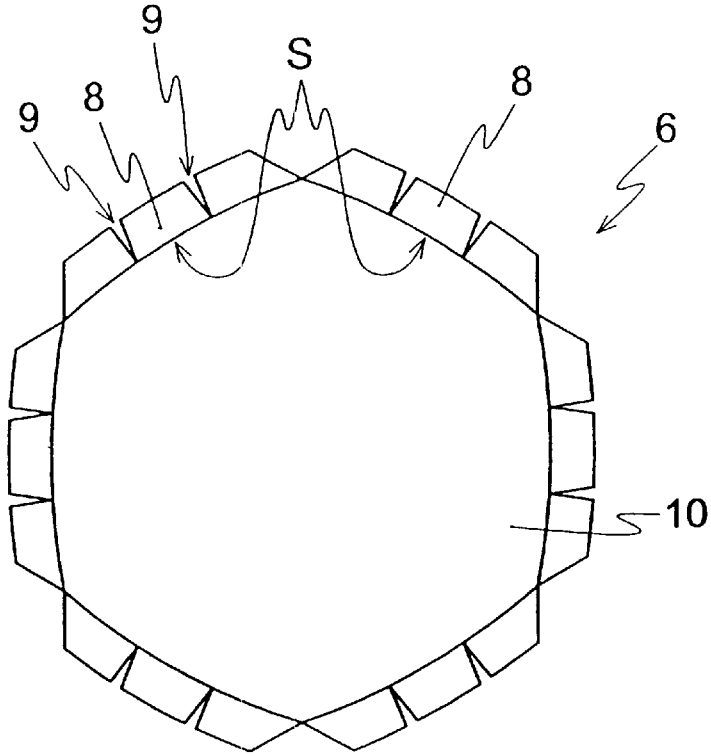
FIG. 3 is a plan view showing the back of a leather panel.

As shown in FIGS. 2 and 3, the leather panels 6 have ends thereof folded toward the back side by about 180 degrees. Therefore, the bonded ends of the leather panels 6 have almost semicircular sections, on which a trench 7 having the same shape as the shape of the trench of a hand stitched ball is formed. When the leather panels 6 are to be bonded onto the cover rubber layer 5, the butt joints of the leather panels 6 may be bonded. With such a structure, the leather panels 6 are not separated on the joints thereof so that water or the like can be prevented from entering from a stuck portion. Furthermore, the ball itself can be prevented from expanding. Consequently, durability can be enhanced.

In the case where the end of the leather panel 6 is to be folded toward the back side, folded portions 8 need to be provided with V-shaped notches 9 in the middle thereof as shown in FIG. 3. The reason is that each of sides S of the polygonal leather panel 6 is curved slightly outward along the spherical surface. Each of the folded portions 6 can have a width of about 1 to 10 mm, more preferably, about 3 mm.

The reference numeral 10 denotes a thickness adjusting member which is bonded onto a region surrounded by the folded portions 8 on the back of the leather panel 6 described above and is set to almost the same thickness as the thickness of the leather panel 6. More specifically, the leather panel 6 usually has a thickness of about 1.6 to 1.8 mm. Therefore, the thickness adjusting member 10 is also set to the same thickness. Consequently, a difference in step generated between the folded portions 8 and the back of the leather panel 6 can be eliminated. One or more woven fabrics can be used for the thickness adjusting member 10. In the case where a plurality of woven fabrics are used, they are overlapped and bonded with a latex paste or the like. Cotton fabrics or mixed to spinning of cotton and polyester is usually suitable for the woven fabric. If three or four woven fabrics are overlapped, the above-mentioned thickness can be obtained.

In a laminated ball, a shape thereof such as sphericity can be kept by the reinforced layer 4. Therefore, in the case where the leather 15 panel 6 is bonded onto the reinforced layer 4 directly or through the cover rubber layer 5, the leather panel 6 side is bent along the difference in step of the folded portions 8 and is bonded onto the reinforced layer 4 side when the thickness adjusting member 10 is not provided. Consequently, there is a problem in that a smooth spherical surface cannot be obtained. The thickness adjusting member 10 solves the problem, and changes the back of the leather panel 6 into a flat face so that the surface thereof is therefore made smooth.

Figure 4:
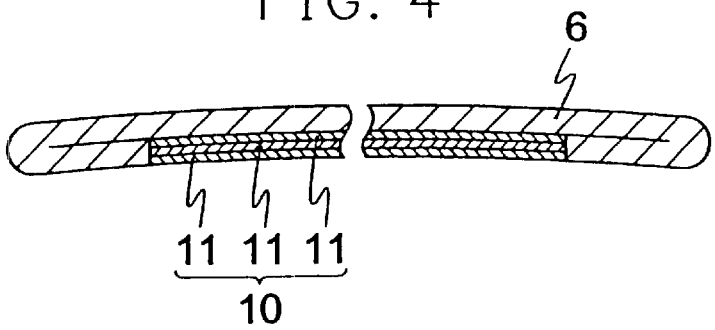
FIG. 4 is a sectional view showing a leather panel according to the embodiment.

FIG. 4 shows a structure in which three woven fabrics 11, 11, 11 are stuck together to form the thickness adjusting member 10. The woven fabric 11 has a continuous waveform structure in which a warp (a warp yarn) and a weft (a weft yarn) are caused to intersect each other to sew respective upper or lower sides each other. In the case where the woven fabric 11 is stretched in a direction having an angle of 45 degrees with respect to the warp and the weft, great expanding action can be obtained which is referred to as a bias effect. When external force is applied to the ball, the bias effect of the woven fabric 11 does not prevent the ball expanding according to the external force from being deformed. Moreover, since the woven fabric 11 has great tensile strength in the directions of the warp and the weft, it also has the function of strengthening the leather panel 6. Furthermore, also in the case where such external force as to damage and break the leather panel 6 is applied, the same force is intercepted by the woven fabric 11. Therefore, the bladder 2 is rarely broken.

Figure 5:
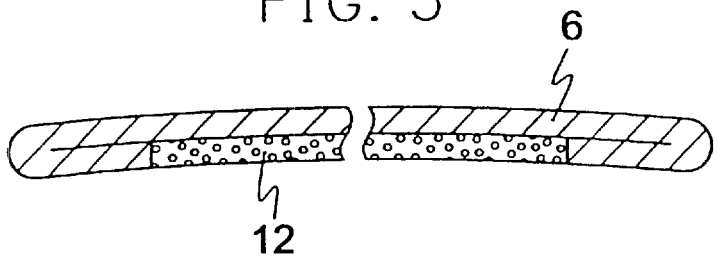
FIG. 5 is a sectional view showing a leather panel according to another embodiment.

FIG. 5 shows a structure in which the shock absorbing member 12 is used for the thickness adjusting member 10 in place of the woven fabric 11. A foaming member made of chloroprene (CR), polyurethane (PV), ethylene—vinyl acetate copolymer (EVA), polyethylene, polyvinyl chloride (PVC), natural rubber latex, synthetic rubber latex, polystyrene, polyolefine, ethylene—propylene—diene ternary copolymer rubber (EPDM) or the like, a nonwoven fabric, a three-dimensional bulky woven fabric or a honeycomb construction member is suitable for the material of the shock absorbing member 12, for example. A sheet such as the foaming member or the like is bonded onto the back of the leather panel 6 to eliminate the difference in step of the folded portion 8. In addition to the above-mentioned example, the lamination structure of the woven fabric 11 and the shock absorbing member 12 can also be employed for the thickness adjusting member 10. The bulky woven fabric includes plural layers in which a weft is entangled in the woven fabrics of respective layers and has a three-dimensional soft structure. The honeycomb construction member is obtained by punching a nonwoven fabric or sponge (a foaming member of polyurethane, EPDM or chloroprene rubber) in the form of a honeycomb.

Figure 6:
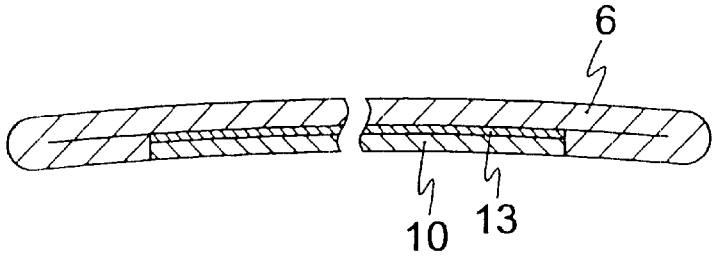
FIG. 6 is a sectional view showing a leather panel according to yet another embodiment.

FIG. 6 shows a structure in which the reinforced layer 13 is provided between the leather panel 6 and the thickness adjusting member 10. A polyester film, a PVC film, a polyethylene film and a polypropylene film are suitable for the material of the reinforced layer 13. The reason is that each of these films can be formed with great tensile strength, flexibility, light weight and small thickness. In the case where the shock absorbing member 12 is used as the thickness adjusting member 10 in place of the woven fabric 11, the reinforced layer 13 is more effective. The reason is that the shock absorbing member 12 has smaller mechanical strength than the mechanical strength of the woven fabric 11.

Figure 7:
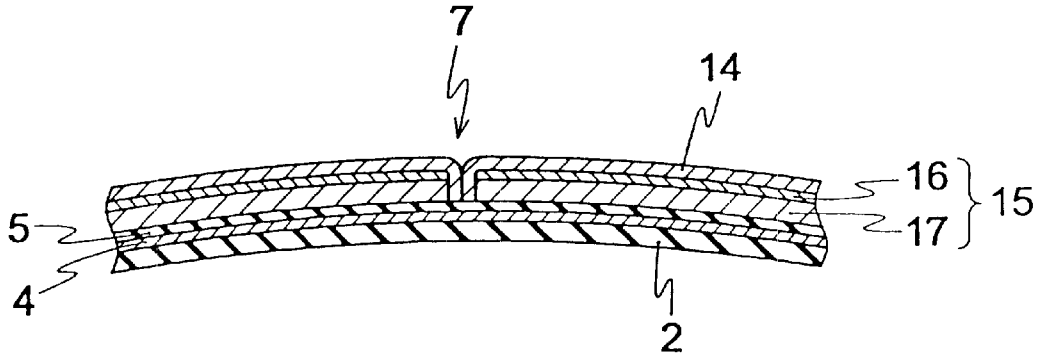
FIG. 7 is a sectional view showing a leather panel according to a further embodiment.

FIG. 7 shows another embodiment in which the peripheral edge portion of a leather panel 14 is folded toward an inside by about 90 degrees with a corner portion rounded and the side face of a thickness adjusting member 15 is covered with the folded portion. A backing member such as a woven fabric for reinforcement may be fixed to the back of the leather panel 14 in the same manner as the above-mentioned leather panel 6. In this case, the leather panel 14 is used including such a backing member. The thickness adjusting member 15 has a two-layered structure of a woven fabric 16 and a shock absorbing member 17. The woven fabric 16 can be made of the same material as the material of the above-mentioned thickness adjusting member 10, and can have one or two woven fabrics overlapped. The shock absorbing member 17 can also be made of the same material as the material of the above-mentioned shock absorbing member 12. These materials are bonded to each other with an adhesive such as a natural latex, a chloroprene (CR) based adhesive, a polyurethane (PU) based adhesive or the like, and is bonded onto the back of the leather panel 14. The leather panel 14 onto which the thickness adjusting member 15 is bonded is bonded onto the cover rubber layer 6 with the CR based adhesive in the same manner as in the above-mentioned example. The whole leather panel 14 can have a thickness of 2 to 10 mm, and the shock absorbing member 17 can have a thickness of 1 to 7 mm. With such a structure, a trench 7 is formed on the peripheral edge of the leather panel 14 which is bent at an angle of about 90 degrees. In order to prevent the joint of the leather panel 14 on which the trench 7 is to be formed from opening, the joint is bonded together with the PU based adhesive or the like. Consequently, water can be prevented from entering from a butt joint. In addition, the joint does not open. Therefore, constant beauty can be kept for a long period of time. Moreover, the peeling of the leather panel 14 and the thickness adjusting member 15 can be prevented so that the durability of the ball can be enhanced.

Figure 8:
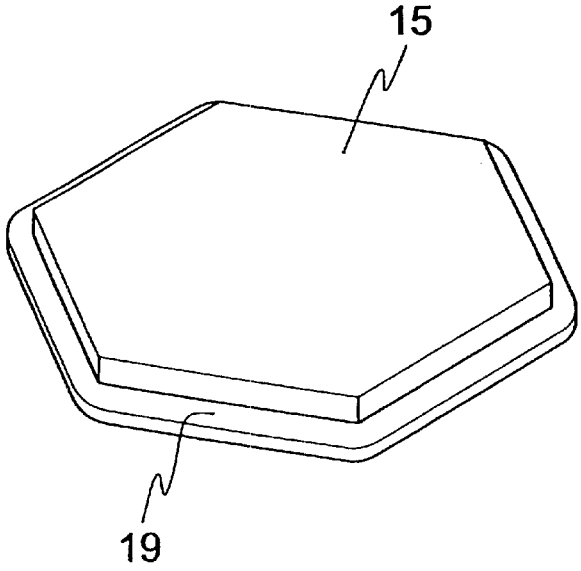
FIG. 8 is a view illustrating a method for bonding the leather panel onto a thickness adjusting member.
Figure 9:
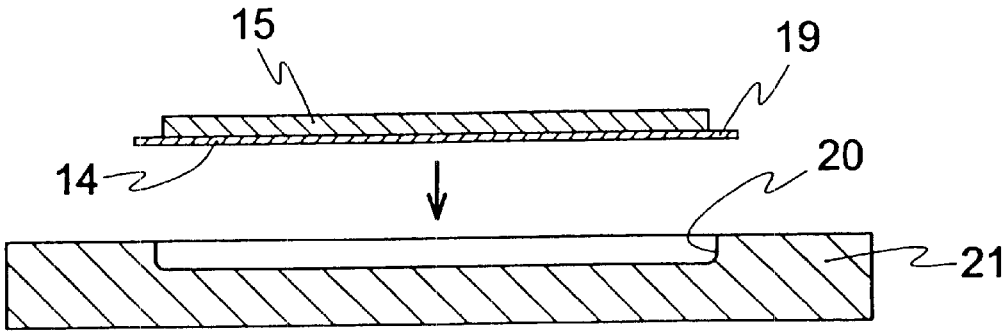
FIG. 9 is a view illustrating the method for bonding the leather panel onto the thickness adjusting member.
Figure 10:
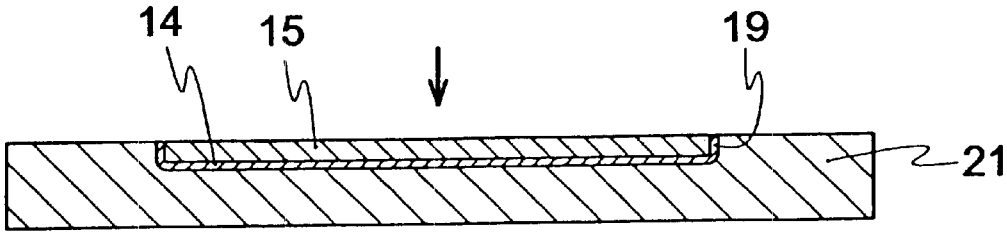
FIG. 10 is a view illustrating the method for bonding the leather panel onto the thickness adjusting member.

FIGS. 8 to 10 show a method for bonding the leather panel 14 and the thickness adjusting member 15. For example, the thickness adjusting member 15, that is, the woven fabric 16 and the shock absorbing member 17 are provided in turn on the back of the leather panel 14 cut into a hexagon and are bonded together with an adhesive such as the natural latex, the CR based adhesive, the PU based adhesive or the like. A folded portion 19 for covering the thickness adjusting member 15 is formed on the peripheral edge portion of the leather panel 14. Each corner portion of the leather panel 14 is cut with roundness in such a manner that a sharp portion is not formed by bending as shown in FIG. 8. The leather panel 14 is formed by applying the same adhesive as described above onto the folded portion 19 and then pressing the leather panel 14 and the thickness adjusting member 15 by means of a metal mold 21 having a concave portion 20 whose shape is almost equal to the shape of the thickness adjusting member 15. At this time, the folded portion 19 is bent to cover the side face of the thickness adjusting member 15 (FIGS. 9 and 10) onto which the folded portion 19 is bonded. The bonding of the panel butt joint is performed by bonding the folded portion 19 of the leather panel 14 onto that of the adjacent leather panel 14.

Figure 11:
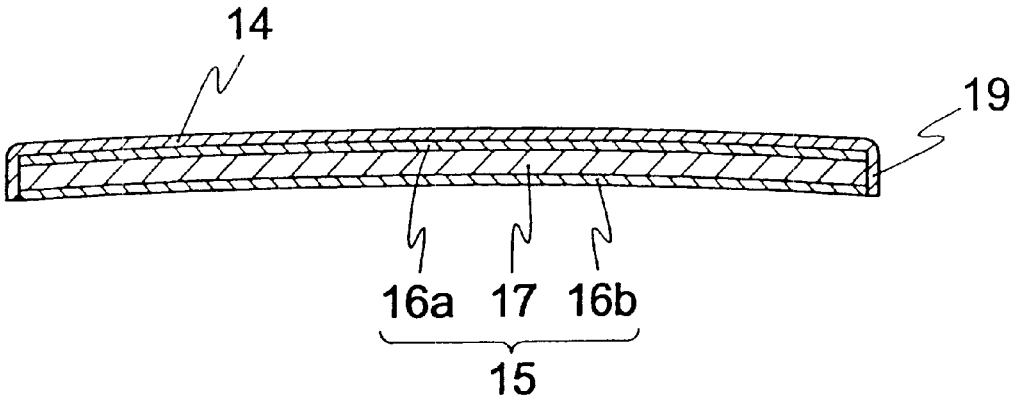
FIG. 11 is a sectional view showing a leather panel according to a further embodiment.
Figure 12:
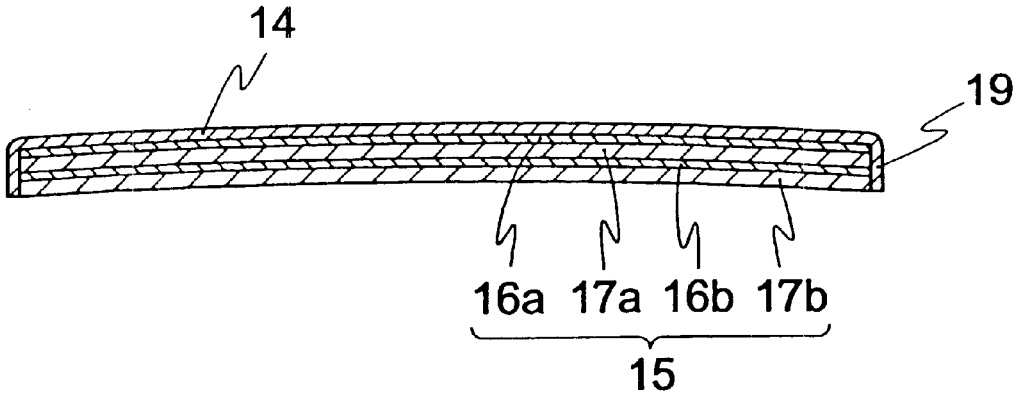
FIG. 12 is a sectional view showing a leather panel according to a further embodiment.
Figure 13:
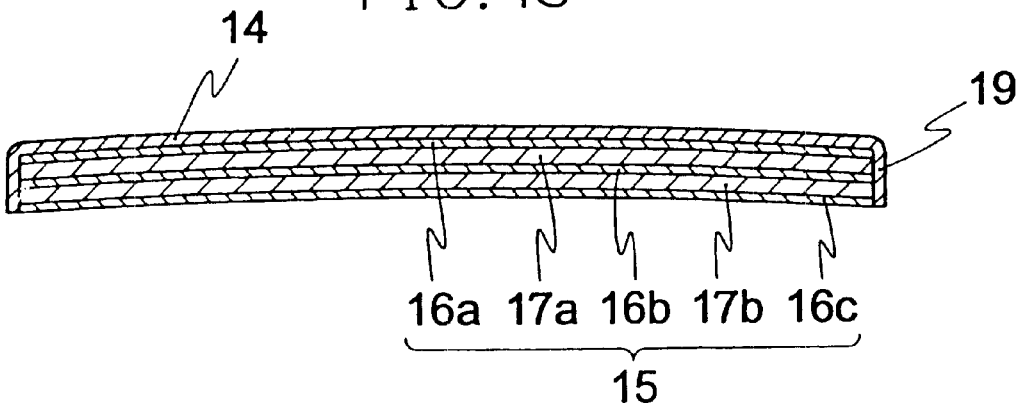
FIG. 13 is a sectional view showing a leather panel according to a further embodiment.

FIGS. 11 to 13 show another structure of the leather panel 14. FIG. 11 shows the thickness adjusting member 15 constituted by the shock absorbing member 17 and two-layered woven fabrics 16*a* and 16*b* interposing the shock absorbing member 17 therebetween, FIG. 12 shows the thickness adjusting member 15 constituted by the two-layered woven fabrics 16*a* and 16*b* and two-layered shock absorbing members 17*a* and 17*b* which are provided alternately, and furthermore, FIG. 13 shows the thickness adjusting member 15 constituted by three-layered woven fabrics 16*a*, 16*b* and 16*c* and the two-layered shock absorbing members 17*a* and 17*b* which are provided alternately. By increasing the woven fabrics 16*a*, 16*b*, the strength of the thickness adjusting member 15 is increased and the function of protecting the bladder 2 (FIG. 7) is enhanced at the same time. More specifically, if the ball hits a sharp object so that the leather panel 14 is broken, the force is first intercepted by the woven fabric 16*a*. Even if the woven fabric 16*a* is broken, the woven fabric 16*b*, and furthermore, the woven fabric 16*c* (in case of three layers) can protect the bladder.

Figure 14:
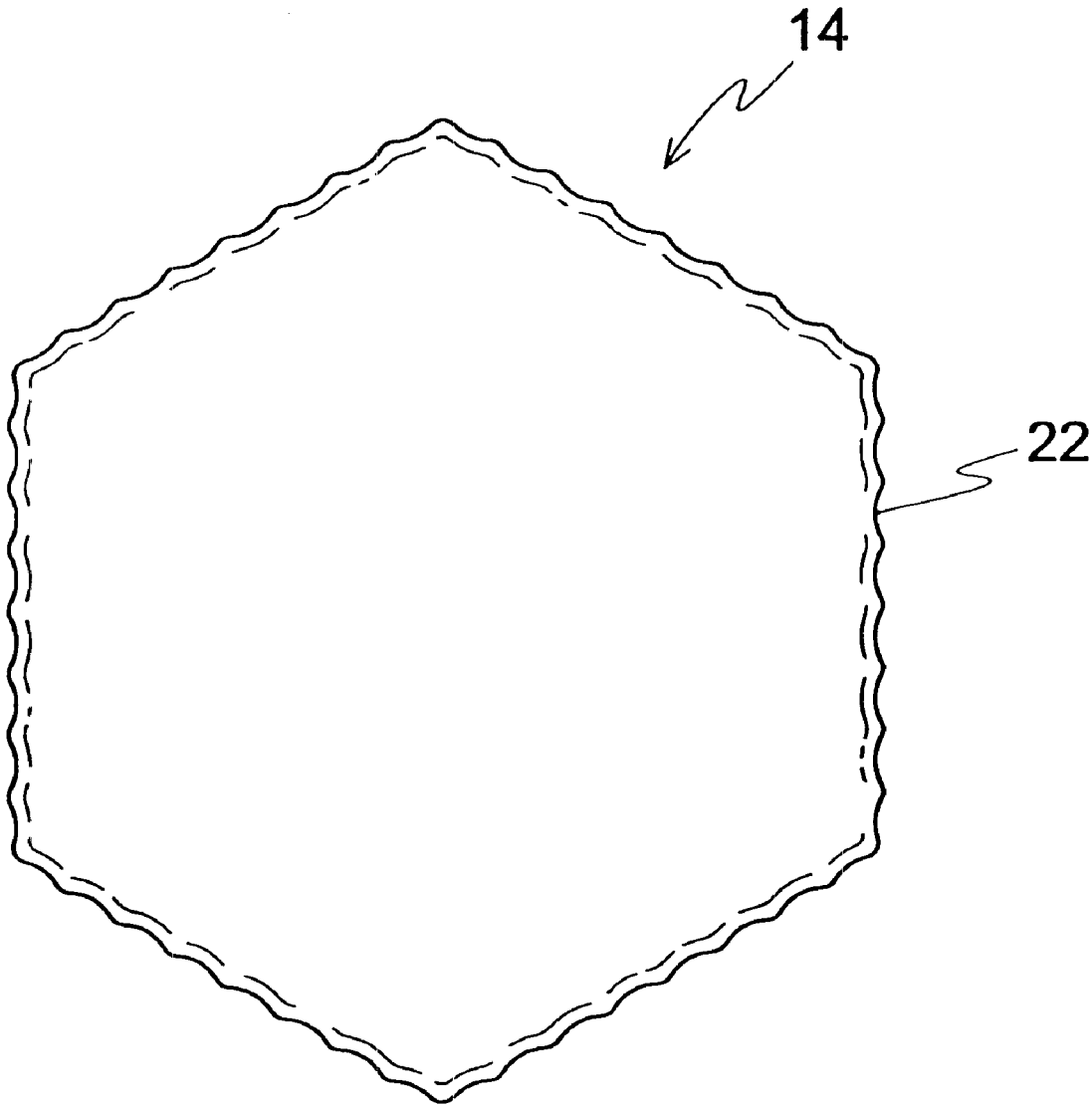
FIG. 14 is a plan view illustrating a leather panel according to a further embodiment.

Pentagonal and hexagonal leather panels usually have each side curved slightly outward in order to cover the spherical surface. In an actual hand stitched ball, the joint of the leather panel is stretched by a sewing thread so that a smooth curve is not formed but the periphery of the leather panel often presents a waveform in which a thread portion projects. As shown in FIG. 14, therefore, an irregularity 22 having a waveform can also be formed on the periphery of the leather panel 14. Consequently, it is possible to implement a ball having an appearance which is more similar to the hand stitched ball. With such a structure, the edge of the trench of the joint presents an irregularity. Therefore, gripping properties can be improved and aerodynamic characteristics can be enhanced. The irregularity 22 having the waveform on the periphery of the leather panel 14 can be formed by thermal press or high-frequency working.

While the description has been given by taking the soccer ball as an example in the above-mentioned first embodiment, the present invention can also be applied to a handball, a volleyball, a playground ball, a basketball, a rugby ball and the like. In case of the handball, the shape of the leather panel is almost the same as that of the soccer ball. In case of the volleyball and the playground ball, the shape of the leather panel is set to a rectangle having each side curved outward.

Next, description will be given to the results of comparison of the characteristics of the ball according to the embodiment of the present invention with those of a ball according to the prior art. For a soccer ball (number five size) according to the embodiment of the present invention, a bladder and a thread winding reinforced layer had a conventional structure. For a leather panel, a peripheral edge portion was folded toward an inside by 90 degrees. For a thickness adjusting member, one polyester—cotton mixed spinning fabric and a CR foaming member were provided. The total thickness of the leather panel and the thickness adjusting member was 5 mm. A trench formed on a butt joint of the leather panels had a width of 2.5 mm and a depth of 2 mm. As a comparative example, typical hand-stitched and laminated balls which have the same size were used.

Compression test: Table 1 indicates a growth rate (an expansion coefficient of a circumference) obtained when 33% of compression is repeated 30,000 times in the direction of the diameter of the ball.

TABLE 1

| Type of ball | Growth rate (%) |
|---|---|
| Ball according to the embodiment | 0.60 |
| Hand stitched ball | 1.71 |
| Laminated ball | 0.55 |

As is apparent from the Table 1, the ball according to the embodiment presents a growth rate which is almost equal to the growth rate of the laminated ball, and the hand stitched ball presents a great growth rate. This means that the ball according to the embodiment and the laminated ball are excellent in durability but the hand stitched ball is inferior to them. A difference in the durability mainly depends on a difference in a reinforced layer.

Figure 15:
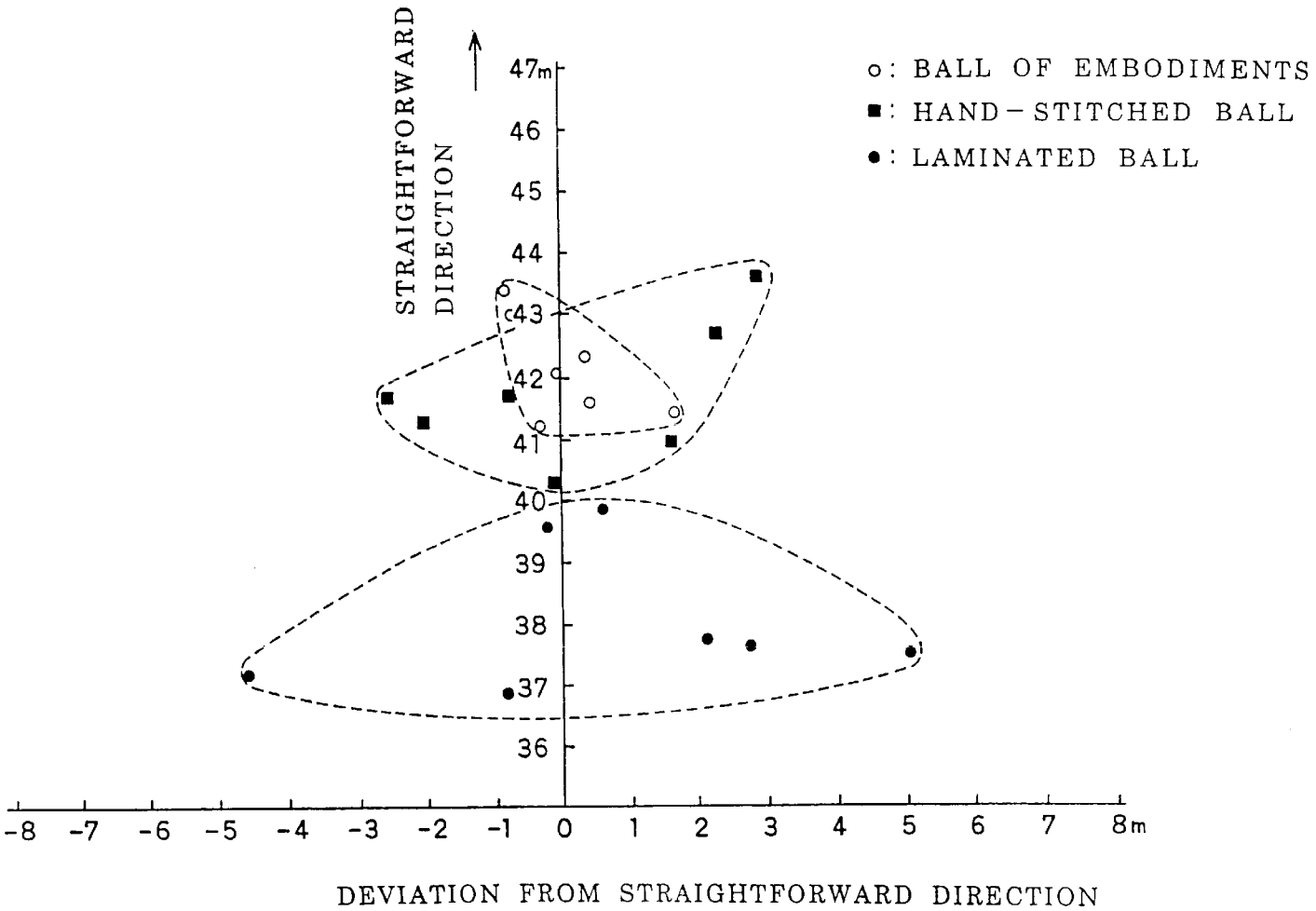
FIG. 15 is a graph representing a flight.

Flight test: FIG. 15 shows a flight (in a rectilinear direction) obtained when kicking is performed at a constant initial speed and a constant angle by means of a kicking machine.

The following is apparent from the result.

(a) The ball according to the embodiment and the hand stitched ball have great flights than the flight of the laminated ball.

(b) The ball according to the embodiment and the hand stitched ball have flights almost equal to each other.

(c) As compared with the ball according to the embodiment, the hand stitched ball and the laminated ball have great movement in a transverse direction. The movement is increased in order of the ball according to the embodiment, the hand stitched ball and the laminated ball.

The reason why the hand stitched ball has the great movement is as follows. It is supposed that the shape of the trench of a hand-stitched portion is ununiform (which is caused by hand stitching) to make a difference in an air resistance depending on the portion of the spherical surface of the ball. On the other hand, in the ball according to the embodiment, the work for bonding the leather panel and the thickness adjusting member can be performed by means of a machine. Therefore, the quality of the ball according to the embodiment is stable. Accordingly, the trench of the panel joint has a uniform shape. Consequently, the air resistance is uniform. Thus, it is supposed that movement is not caused on a track.

The reason why the laminated ball has a small flight is that the shape of the trench does not cause the air resistance to be reduced. The reason why the movement of the track of the laminated ball is great is that small track stabilizing effects are obtained by the trench. As described above, the ball according to the embodiment has the greatest flight and the smallest movement. Therefore, it is apparent that the ball according to the embodiment is easy for a player to control and use.

Figure 16:
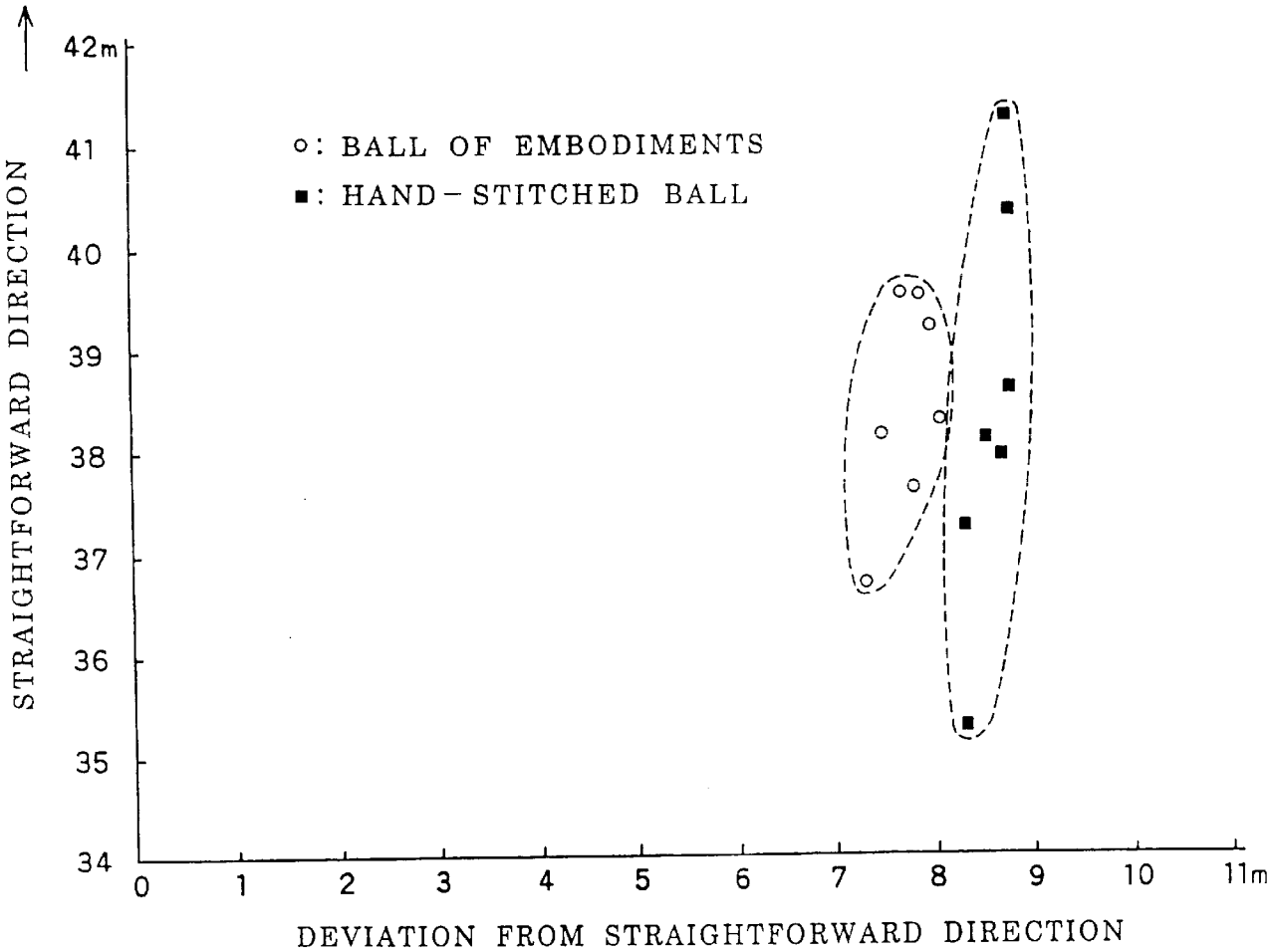
FIG. 16 is a graph representing a curve characteristic.

Curve characteristic test: FIG. 16 shows a curve characteristic obtained when kicking is performed by rotation at a constant initial speed and a constant angle using the same kicking machine as described above. The laminated ball has extremely great movement in the rectilinear and transverse directions as compared with the ball according to the embodiment and the hand stitched ball. Therefore, data were omitted. The following is clear for the above-mentioned two types of balls.

(a) The ball according to the embodiment has smaller movement in the rectilinear direction than the hand stitched ball.

(b) The curve rate of the hand stitched ball is a little greater.

By this result, it is clear that the ball according to the embodiment has the curve characteristic which is slightly poorer than the curve characteristic of the hand stitched ball but has a small variation in a landing area. In an actual game, such a difference in the curve characteristic rarely matters. It is more important that the variation in the landing area should be stable. Once the player recognizes the curve characteristic of the ball, he (or she) can perform control. However, the player cannot predict the movement of the flight.

There has been described the case where a thread winding reinforced layer having a conventional structure, that is, a reinforced layer obtained by winding about 3000 m of a nylon filament around the bladder surface in every direction to give sphericity, spherical maintenance, strength and durability to the ball is used for the reinforced layer of the ball in the above-mentioned test. Also in the case where a reinforced layer which is obtained by sticking or sewing the above-mentioned woven fabrics together to take the spherical shape and gives the above-mentioned characteristics, and furthermore, a bladder having its own reinforcing function are used, almost the same results can be obtained. It is important that the reinforced layer is formed almost uniformly over the whole bladder surface and the ball is therefore excellent in sphericity and shape maintenance thereof. In addition to such a premise, by using the leather panel according to the present invention, the flight can be enhanced, the flight can be stabilized and the curve characteristics can be stabilized as described above.

In one embodiment of the present invention, the quality such as sphericity, shape maintenance, durability or the like is kept equivalent to the quality of the laminated ball, and the leather panel joint has the trench having the same shape as in the hand stitched ball. Consequently, the air resistance can be reduced and the flight can be increased. Moreover, the trench causes the ball to be easy to grip. Therefore, operability and ball controllability can be enhanced. Furthermore, the surface of the leather panel presents a smooth sphere. Therefore, a product can become attractive. Furthermore, since the ball according to the present invention basically has a laminated ball structure, it can be mechanically manufactured. Consequently, stable quality and low cost can be achieved.

In one embodiment of the present invention, water can be prevented from entering from the joint of the leather panels. In addition, the peeling of the leather panel can be prevented so that durability can be enhanced.

In one embodiment of the present invention, the peripheral edge of the leather panel to achieve the ball surface which is usually polygonal and has each side curved slightly outward can easily be folded toward the back side. Consequently, there is no possibility that the sphericity might be deteriorated and irregularities might be generated on the joint of the leather panels. In one embodiment of the present invention, at the same time that the strength of the leather panel itself is increased, the bladder is protected. Therefore, also in the case where external force to break the leather panel is applied to the ball, the bladder is rarely damaged.

In one embodiment of the present invention, a great shock absorbing function can be obtained. When the ball hits a human body, a shock can be relaxed and pains can be relieved to get a soft feeling.

In one embodiment of the present invention, the woven fabric can protect the shock absorbing member and the bladder which are provided on the inside thereof. Furthermore, it is possible to obtain the shock absorbing function by the shock absorbing member.

In one embodiment of the present invention, the foaming member, the nonwoven fabric, the bulky woven fabric or the honeycomb construction member has light weight. Therefore, the weight of the ball itself can be reduced, and it is possible to obtain a shock absorbing and relieving function which is more excellent in the cushioning properties of the ball.

A ball for a ball game according to the present invention has high durability and low cost. Therefore, the ball is useful for physical education and club activities of school, that is, practice as well as regular games such as the Olympic Games.

What is claimed is:

1. A ball for a ball game comprising:

an elastic bladder having a form of a generally spherical hollow body into which compressed air is charged;

a reinforced layer formed on a whole surface of the bladder; and a plurality of leather panels bonded onto the reinforced layer, wherein a peripheral edge portion of each leather panel is folded toward an inside and a thickness adjusting member is disposed in a void defined by the folded peripheral portions and bonded onto a back of each leather panel.

2. The ball for ball game of claim 1, further comprising a cover rubber layer formed on the reinforced layer.

3. The ball for ball game of claim 1, wherein the peripheral edge portion of the leather panel is folded toward the inside by about 180 degrees.

4. The ball for ball game of claim 1, wherein the peripheral edge portion of the leather panel is folded toward the inside by about 90 degrees.

5. The ball for ball game of claim 1, wherein the leather panel is bonded in a joint with an adjacent leather panel.

6. The ball for ball game of claim 3, wherein a notch is formed in the folded portion of the leather panel.

7. The ball for ball game of claim 1, wherein the thickness adjusting member is made of a woven fabric.

8. The ball for ball game of claim 1, wherein the thickness adjusting member is made of a shock absorbing member.

9. The ball for ball game of claim 1, wherein the thickness adjusting member has a lamination structure of a woven fabric and a shock absorbing member.

10. The ball for ball game of claim 8 wherein the shock absorbing member comprises a material selected from the group consisting of a foaming member, a nonwoven fabric, a bulky woven fabric, and a honeycomb construction member.

11. The ball for ball game of claim 1, wherein a reinforcing member is provided between the leather panel and the thickness adjusting member.

12. The ball for ball game of claim 11, wherein the reinforcing member comprises a material selected from the group consisting of a polyester film, a PVC film, a polyethylene film, and a polypropylene film.

* * * * *

US006685585C1

(12) INTER PARTES REEXAMINATION CERTIFICATE (0079th)

United States Patent

Shishido et al.

(10) Number: US 6,685,585 C1

(45) Certificate Issued: *Jul. 14, 2009

(54) BALL FOR BALL GAME

(75) Inventors: Hideomi Shishido, Hiroshima (JP); Shigeo Doi, Hiroshima (JP); Yoshihisa Okimura, Hiroshima (JP)

(73) Assignees: adidas International B.V., Amsterdam (NL); Molten Corporation, Hiroshima (JP)

Reexamination Request:
No. 95/000,133, Mar. 9, 2006

Reexamination Certificate for:

| | |
|---|---|
| Patent No.: | **6,685,585** |
| Issued: | **Feb. 3, 2004** |
| Appl. No.: | **10/293,847** |
| Filed: | **Nov. 13, 2002** |

( * ) Notice: This patent is subject to a terminal disclaimer.

Related U.S. Application Data

(63) Continuation of application No. 09/700,615, filed as application No. PCT/JP99/02667 on May 20, 1999, now Pat. No. 6,503,162.

(30) Foreign Application Priority Data

May 22, 1998 (JP) ..... 10-141882

(51) Int. Cl.
*A63B 41/10* (2006.01)

(52) U.S. Cl. ..... 473/605; 473/599

(58) Field of Classification Search ..... None
See application file for complete search history.

(56) References Cited

U.S. PATENT DOCUMENTS

| | | | |
|---|---|---|---|
| 415,884 | A | 11/1889 | Shibe |
| 1,187,029 | A | 6/1916 | Beebout |
| 1,614,853 | A | 11/1927 | Schwartz |
| 1,923,236 | A | 8/1933 | Sonnett |
| 2,078,881 | A | 4/1937 | Münzinger |
| 2,221,534 | A | 11/1940 | Voit et al. |
| 2,653,818 | A | 9/1953 | Tebbetts, Jr. et al. |
| 2,874,964 | A | 2/1959 | Edwards |
| 3,112,521 | A | 12/1963 | Ward |
| 3,119,618 | A | 1/1964 | Molitor et al. |
| 3,185,476 | A | 5/1965 | Fechner |
| 3,508,750 | A | 4/1970 | Henderson |
| 4,065,150 | A | 12/1977 | Van Auken |
| 4,154,789 | A | 5/1979 | Delacoste |
| 4,157,424 | A | 6/1979 | Boulle |
| 4,187,134 | A | 2/1980 | Svub et al. |
| 4,261,565 | A | 4/1981 | Massino |
| 4,285,846 | A | 8/1981 | Hardy et al. |
| 4,318,544 | A | 3/1982 | Brine |
| 4,333,648 | A | 6/1982 | Aoyama |
| 4,399,992 | A | 8/1983 | Molitor |
| 4,462,590 | A | 7/1984 | Mitchell |
| 4,660,831 | A | 4/1987 | Kralik |
| 4,798,386 | A | 1/1989 | Berard |
| 4,802,671 | A | 2/1989 | Gentiluomo |
| 4,826,177 | A | 5/1989 | Ponte |
| 4,856,781 | A | 8/1989 | Shishido et al. |
| 4,998,734 | A | 3/1991 | Meyer |

(Continued)

FOREIGN PATENT DOCUMENTS

| | | |
|---|---|---|
| CH | 403593 | 6/1966 |
| DE | 829 109 | 7/1949 |
| DE | 1 172 585 | 9/1960 |

(Continued)

*Primary Examiner*—Beverly M. Flanagan

(57) ABSTRACT

A ball for a ball game includes an elastic bladder having the form of a spherical hollow body into which compressed air is charged, a reinforced layer formed on a whole surface of the bladder, and a plurality of leather panels bonded onto the reinforced layer directly or through a cover rubber layer, wherein a peripheral edge portion of the leather panel is folded toward an inside and a thickness adjusting member for eliminating a difference in step caused by the folding of the leather panel is caused to be bonded onto the back of the leather panel surrounded by the folded portion of the leather panel.

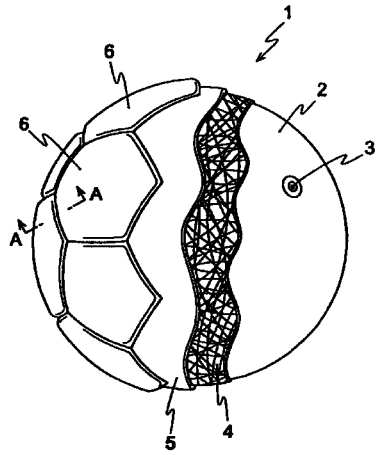

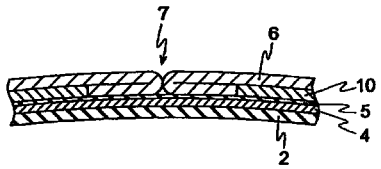

U.S. PATENT DOCUMENTS

| | | | |
|---|---|---|---|
| 5,040,795 | A | 8/1991 | Sonntag |
| 5,091,265 | A | 2/1992 | Kennedy et al. |
| 5,104,126 | A | 4/1992 | Gentiluomo |
| 5,123,659 | A | 6/1992 | Williams |
| 5,181,717 | A | 1/1993 | Donntag et al. |
| 5,310,178 | A | 5/1994 | Walker et al. |
| 5,320,345 | A | 6/1994 | Lai et al. |
| D352,317 | S | 11/1994 | Bassignani |
| 5,405,469 | A | 4/1995 | Lin |
| 5,413,331 | A | 5/1995 | Stillinger |
| D360,917 | S | 8/1995 | Fernandez Monso |
| 5,516,107 | A | 5/1996 | Okumoto et al. |
| 5,624,517 | A | 4/1997 | Giesen et al. |
| 5,649,701 | A | 7/1997 | Mills et al. |
| 5,672,120 | A | 9/1997 | Ramirez et al. |
| 5,688,192 | A | 11/1997 | Aoyama |
| 5,688,198 | A | 11/1997 | Teifert et al. |
| 5,711,725 | A | 1/1998 | Bengtson |
| 5,741,195 | A | 4/1998 | Sullivan et al. |
| 5,752,890 | A | 5/1998 | Shishido et al. |
| 5,755,634 | A | 5/1998 | Huang |
| 5,759,123 | A | 6/1998 | Ou |
| 5,766,707 | A | 6/1998 | Obermaier |
| 5,772,545 | A | 6/1998 | Ou |
| 5,823,889 | A | 10/1998 | Aoyama |
| 5,865,697 | A | 2/1999 | Molitor et al. |
| 5,888,157 | A | 3/1999 | Guenther et al. |
| 5,931,752 | A | 8/1999 | Guenther et al. |
| D418,565 | S | 1/2000 | Burgess |
| 6,099,423 | A | 8/2000 | Ou |
| 6,157,898 | A | 12/2000 | Marinelli |
| 6,206,795 | B1 | 3/2001 | Ou |
| 6,245,862 | B1 | 6/2001 | Rajagopalan |
| 6,251,035 | B1 | 6/2001 | Fa |
| 6,302,815 | B1 | 10/2001 | Shishido et al. |
| 6,306,054 | B1 | 10/2001 | Dobrounig |
| 6,458,229 | B2 | 10/2002 | Dobrounig |
| 6,503,162 | B1 | 1/2003 | Shishido et al. |
| 6,638,189 | B2 | 10/2003 | Chang |
| D482,418 | S | 11/2003 | Estefano |
| 6,685,585 | B2 | 2/2004 | Shishido et al. |
| 2002/0077201 | A1 | 6/2002 | Davis |
| 2003/0045383 | A1 | 3/2003 | Jiminez |
| 2003/0073526 | A1 | 4/2003 | Morrison et al. |
| 2003/0144095 | A1 | 7/2003 | Yang |
| 2004/0012524 | A1 | 1/2004 | Couronne et al. |
| 2005/0170920 | A1 | 8/2005 | Boyer et al. |

FOREIGN PATENT DOCUMENTS

| | | | |
|---|---|---|---|
| DE | 2125758 | | 12/1972 |
| DE | 2723625 | | 5/1982 |
| DE | 3918038 | | 1/1991 |
| DE | 44 34 889 | | 4/1995 |
| DE | 42 33 341 | | 3/1997 |
| DE | 200 04 174 | | 8/2001 |
| DE | 100 29 456 | | 9/2001 |
| DE | 100 29 459 | | 9/2001 |
| DE | 100 29 463 | | 9/2001 |
| DE | 100 29 464 | | 9/2001 |
| EP | 0 894 514 | A2 | 2/1989 |
| EP | 0 385 872 | | 3/1990 |
| EP | 1 080 745 | A1 | 5/1999 |
| FR | 1488920 | | 6/1967 |
| FR | 2215249 | | 8/1974 |
| FR | 2 443 850 | | 7/1980 |
| FR | 78 35342 | | 7/1980 |
| FR | 2 572 674 | | 5/1986 |
| FR | 2 667 510 | | 4/1992 |
| FR | 2 806 922 | | 10/2001 |
| GB | 1 095 969 | | 12/1967 |
| JP | 27-3908 | | 5/1952 |
| JP | 30-10612 | | 10/1954 |
| JP | 33-1619 | | 2/1958 |
| JP | 38-16729 | | 8/1963 |
| JP | 38-16729 | | 8/1964 |
| JP | 54-65638 | | 5/1979 |
| JP | 215335/1983 | | 12/1983 |
| JP | 61-127764 | | 8/1986 |
| JP | 1-265979 | | 10/1989 |
| JP | 58-215335 | | 12/1993 |
| JP | 8-252341 | | 10/1996 |
| JP | 9-019516 | | 1/1997 |
| JP | 10-323409 | | 12/1998 |
| WO | WO 93/06894 | | 4/1993 |
| WO | WO 95/09034 | | 4/1995 |
| WO | WO/96/40380 | | 12/1996 |
| WO | WO 97/17109 | | 5/1997 |
| WO | WO 97/20449 | | 6/1997 |
| WO | WO 99/15242 | | 4/1999 |
| WO | WO 99/61114 | | 12/1999 |
| WO | DM/055893 | | 4/2001 |
| WO | WO 01/66201 | | 9/2001 |
| WO | WO 2005/044396 | | 5/2005 |

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 4, 5 and 7–10 are cancelled.

Claims 3 and 11 are determined to be patentable as amended.

Claims 6 and 12, dependent on an amended claim, are determined to be patentable.

New claims 13–33 are added and determined to be patentable.

3. [The ball for ball game of claim 1,] *A ball for a ball game comprising:*

*an elastic bladder having a form of a generally spherical hollow body into which compressed air is charged;*

*a reinforced layer formed on a whole surface of the bladder; and*

*a plurality of leather panels bonded onto the reinforced layer, each leather panel comprising a back, peripheral edge portions, and curved sides,*

*wherein each peripheral edge portion of each leather panel is folded along a corresponding curved side of the panel toward an inside; and*

*wherein a thickness adjusting member is disposed in a void defined by the folded peripheral edge portions and is bonded onto the back of each leather panel, and has a thickness substantially a same thickness as the panel to which the thickness adjusting member is bonded; and* wherein the peripheral edge portion of the leather panel is folded toward the inside by about 180 degrees.

11. [The ball for ball game of claim 1,] *A ball for a ball game comprising:*

*an elastic bladder having a form of a generally spherical hollow body into which compressed air is charged;*

*a reinforced layer formed on a whole surface of the bladder; and*

*a plurality of leather panels bonded onto the reinforced layer, each leather panel comprising a back, peripheral edge portions, and curved sides,*

*wherein each peripheral edge portion of each leather panel is folded along a corresponding curved side of the panel toward an inside; and*

*wherein a thickness adjusting member is disposed in a void defined by the folded peripheral edge portions and is bonded onto the back of each leather panel, and has a thickness substantially a same thickness as the panel to which the thickness adjusting member is bonded; and* wherein a reinforcing member is provided between the leather panel and the thickness adjusting member.

*13. A ball for a ball game comprising:*

*an elastic bladder having a form of a generally spherical hollow body into which compressed air is charged;*

*a reinforced layer formed on a whole surface of the bladder; and*

*a plurality of leather panels bonded onto the reinforced layer, wherein a peripheral edge portion of each leather panel is folded toward an inside by about 180 degrees and a thickness adjusting member is disposed in a void defined by the folded peripheral portions and bonded onto a back of each leather panel.*

*14. The ball for ball game of claim 13, wherein a notch is formed in the peripheral edge portions of the leather panel.*

*15. A ball for a ball game comprising:*

*an elastic bladder having a form of a generally spherical hollow body into which compressed air is charged;*

*a reinforced layer formed on a whole surface of the bladder; and*

*a plurality of leather panels bonded onto the reinforced layer, wherein a peripheral edge portion of each leather panel is folded toward an inside and a thickness adjusting member is disposed in a void defined by the folded peripheral portions and bonded onto a back of each leather panel, and wherein a reinforcing member is provided between the leather panel and the thickness adjusting member.*

*16. The ball for ball game of claim 15, wherein the reinforcing member comprises a material selected from the group consisting of a polyester film, a PVC film, a polyethylene film, and a polypropylene film.*

*17. The ball for ball game of claim 13, further comprising a cover rubber layer formed on the reinforced layer.*

*18. The ball for ball game of claim 13, wherein the leather panel is bonded in a joint with an adjacent leather panel.*

*19. The ball for ball game of claim 13, wherein the thickness adjusting member is made of a woven fabric.*

*20. The ball for ball game of claim 13, wherein the thickness adjusting member is made of a shock absorbing member.*

*21. The ball for ball game of claim 20, wherein the shock absorbing member comprises a material selected from the group consisting of a foaming member, a nonwoven fabric, a bulky woven fabric, and a honeycomb construction member.*

*22. The ball for ball game of claim 13, wherein the thickness adjusting member has a lamination structure of a woven fabric and a shock absorbing member.*

*23. The ball for ball game of claim 13, wherein a reinforcing member is provided between the leather panel and the thickness adjusting member.*

*24. The ball for ball game of claim 23, wherein the reinforcing member comprises a material selected from the group consisting of a polyester film, a PVC film, a polyethylene film, and a polypropylene film.*

*25. The ball for ball game of claim 15, further comprising a cover rubber layer formed on the reinforced layer.*

*26. The ball for ball game of claim 15, wherein the peripheral edge portion of each leather panel is folded toward the inside by about 180 degrees.*

*27. The ball for ball game of claim 15, wherein the peripheral edge portion of each leather panel is folded toward the inside by about 90 degrees.*

*28. The ball for ball game of claim 15, wherein the leather panel is bonded in a joint with an adjacent leather panel.*

*29. The ball for ball game of claim 26, wherein a notch is formed in the folded portion of the leather panel.*

*30. The ball for ball game of claim 15, wherein the thickness adjusting member is made of a woven fabric.*

*31. The ball for ball game of claim 15, wherein the thickness adjusting member is made of a shock absorbing member.*

*32. The ball for ball game of claim 31, wherein the shock absorbing member comprises a material selected from the group consisting of a foaming member, a nonwoven fabric, a bulky woven fabric, and a honeycomb construction member.*

*33. The ball for ball game of claim 15, wherein the thickness adjusting member has a lamination structure of a woven fabric and a shock absorbing member.*

* * * * *